US006321044B1

(12) United States Patent
Tanaka

(10) Patent No.: US 6,321,044 B1
(45) Date of Patent: Nov. 20, 2001

(54) IMAGE FORMING APPARATUS AND METHOD

(75) Inventor: Toshiaki Tanaka, Fukaya (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/669,690

(22) Filed: Sep. 26, 2000

(30) Foreign Application Priority Data

Sep. 28, 1999 (JP) ..... 11-274885

(51) Int. Cl.[7] ..... G03G 15/00
(52) U.S. Cl. ..... 399/49; 399/72; 399/74
(58) Field of Search ..... 399/38, 41, 46, 399/44, 49, 72, 74

(56) References Cited

U.S. PATENT DOCUMENTS 5,196,886 3/1993 Nakane et al. ..... 399/27
5,294,959 * 3/1994 Nagao et al. ..... 399/44

* cited by examiner

*Primary Examiner*—Arthur T. Grimley
*Assistant Examiner*—Hoan Tran

(74) *Attorney, Agent, or Firm*—Foley & Lardner

(57) ABSTRACT

An image forming apparatus of the present invention includes an image formation unit for forming a developer image on a photosensitive drum, a transfer belt for conveying a sheet while placing it on a transfer surface and for allowing the developer image formed on the photosensitive drum to be transferred on the sheet or allowing the developer image to be directly transferred on the transfer surface as a mark for control of the image formation, a density sensor provided such that a detecting surface faces the transfer surface of the transfer belt to optically detect the control mark formed on the transfer belt, a control section for controlling the formation of the developer image on the photosensitive drum executed by the image formation unit in accordance with detection information of the density sensor, a shutter plate movably provided between the detecting surface of the density sensor and the transfer surface of the transfer belt to move in a first direction and open the detecting surface of the density sensor when the control mark is detected by the density sensor or to move in a second direction opposite to the first direction and cover the detecting surface of the density sensor when the control mark is not detected, and a discriminating section for optically discriminating the operation of the shutter plate by utilizing the density sensor when the shutter plate is opened or closed.

22 Claims, 10 Drawing Sheets

IMAGE FORMING APPARATUS AND METHOD

CROSS-REFERENCE TO RELATED APPLICATIONS

This application is based upon and claims the benefit of priority from the prior Japanese Patent Application No. 11-274885, filed Sep. 28, 1999, the entire contents of which are incorporated herein by reference.

BACKGROUND OF THE INVENTION

The present invention relates to an image forming apparatus and method in use as, for example, an electrophotographic full-color printer or full-color copier.

As a multi-color image forming apparatus of this type, a quad-tandem color image forming apparatus that comprises a plurality of electrophotographic process units arranged opposite to the same transfer belt is known. In the quad-tandem color image forming apparatus, various controls are executed to obtain an image superposed without displacement.

For example, a rotational speed of a drive motor for a drum or a drive motor for a belt is controlled so as to make a rotational circumferential speed of photosensitive drums of plural electrophotographic process units equal to a moving circumferential speed of the transfer belt. In addition, a plurality of photosensitive drums are arranged with a predetermined gap disposed therebetween. Therefore, the image forming timing to the photosensitive drums can be shifted in time in accordance with the gap of the photosensitive drums.

Actually, however, there are various conditions such as displacement of an exposure beam, misalignment in a pitch of a photosensitive drum, slipping between a transfer belt and the roller which drives the transfer belt, variation in the circumferential speed of the transfer belt caused by the thermal expansion in the diameter of the roller which drives the transfer belt, and the like, and it is therefore difficult to obtain a superposed image having no displacement.

Thus, the color image forming apparatus comprises a sequence of solving a problem of displacement in the superposed image by utilizing the warm-up time after opening a door at the time of turning on a power supply or in a paper jam process.

This apparatus also comprises a sequence of optimizing the image density, which is the amount of adhesion of the toner, even when the characteristics are varied due to the variation in temperature or deterioration in lifetime.

A registration sensor is used for the sequence of solving the displacement in the superposed image, and a toner density sensor is used for the sequence of optimizing the image density. The registration sensor and the toner density sensor are arranged at the most downstream side in the sheet conveying direction so as to detect marks for detection of the toner density and the displacement, which are formed on the transfer belt.

The registration sensor and the toner density sensor are arranged opposite to one another in the close vicinity of the transfer belt.

Incidentally, when a sheet on which a toner image is transferred is conveyed by the transfer belt at the time of image formation, the toner flies off from the toner image since the toner image is in a non-fixed state. For this reason, the flying toner adheres to the registration sensor and the toner density sensor, and may thereby cause stains and make the detection impossible.

If the registration sensor and the toner density sensor are covered with a hood at the time of image formation, adhesion of the flying toner can be prevented. However, the gap between the toner density sensor and the transfer belt is small, i.e. about 5 mm, and thus the hood or the like cannot be used.

In the prior art, for example, the detecting surface of the registration sensor and the toner density sensor has been cleaned by a hand or by a cleaner interlocking with the opening and closing operation of a front door of the apparatus, at the time of maintaining and checking the apparatus.

However, the stains cannot be certainly removed by the cleaning, which causes deterioration in the accuracy of detection. In the cleaning process, the detecting surface of the sensor may be scarred or, on the contrary, a lump of stains may be applied thereto.

BRIEF SUMMARY OF THE INVENTION

The present invention is accomplished by consideration of the above-described circumstances, and the object of the present invention is to provide an image forming apparatus and method capable of preventing adherence of the flying developer on the detecting means, and discriminating whether a member for preventing the adherence of the developer is normally operated or not without providing any additional detecting means.

An image forming apparatus according to the present invention comprises an image forming means for forming a developer image on an image carrier, a detecting means for detecting the developer image formed by the image forming means, a control means for controlling the formation of the developer image on the image carrier executed by the image forming means, in accordance with detection information of the detecting means, an opening/closing member for opening a detecting surface of the detecting means when the developer image is detected by the detecting means, and for covering the detecting surface thereof when the developer image is not detected, and a discriminating means for discriminating a condition of the operation of the opening/closing member by using a result of the detection of the developer image executed by the detecting means.

Another image forming apparatus according to the present invention comprises an image forming means for forming a developer image on an image carrier, a transfer means for conveying a member on which the developer image is to be transferred while placing the member on a transfer surface, and allowing the developer image formed on the image carrier to be transferred on the member or allowing the developer image to be directly transferred on the transfer surface as a mark for control of the image formation, a detecting means provided so that a detecting surface thereof faces the transfer surface of the transfer means, for optically detecting the control mark formed on the transfer surface, a control means for controlling the formation of the developer image on the image carrier executed by the image forming means, in accordance with detection information of the detecting means, an opening/closing member movably provided between the detecting surface of the detecting means and the transfer surface, for moving in a first direction and opening the detecting surface of the detecting means when the control mark is detected by the detecting means and for moving in a second direction opposite to the first direction and covering the detecting surface of the detecting means when the control mark is not detected, and a discriminating means for discriminating a condition of the operation of the opening/closing member by using a result of the detection of the control mark executed by the detecting means when the opening/closing means executes the opening/closing operation.

An image forming method according to the present invention comprises the steps of forming a developer image on an image carrier, detecting the developer image formed at the image forming step, by a detecting means, controlling the formation of the developer image on the image carrier executed at the image forming step, in accordance with detection information obtained at the detecting step, operating an opening/closing member for opening a detecting surface of the detecting means when the developer image is detected by the detecting means, and for covering the detecting surface thereof when the developer image is not detected, and discriminating a condition of the operation of the opening/closing member by using a result of the detection of the developer image executed by the detecting means.

Another image forming method according to the present invention comprises the steps of forming a developer image on an image carrier, conveying a member on which the developer image is to be transferred while placing the member on a transfer surface of a transfer means, and allowing the developer image formed on the image carrier to be transferred on the member or allowing the developer image to be directly transferred on the transfer surface as a mark for control of the image formation, optically detecting the control mark formed on the transfer surface of the transfer means while a detecting surface faces the transfer surface of the transfer means, controlling the formation of the developer image on the image carrier executed at the image forming step, in accordance with detection information obtained at the detecting step, moving an opening/closing member in a first direction and opening the detecting surface of the detecting means when the control mark is detected by the detecting means and moving the opening/closing member in a second direction opposite to the first direction and covering the detecting surface of the detecting means when the control mark is not detected; and optically discriminating a condition of the operation of the opening/closing member by using a result of the detection of the control mark executed by the detecting means when the opening/closing means executes the opening/closing operation.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

The embodiments of the present invention will be explained in detail with reference to the drawings.

Figure 1:
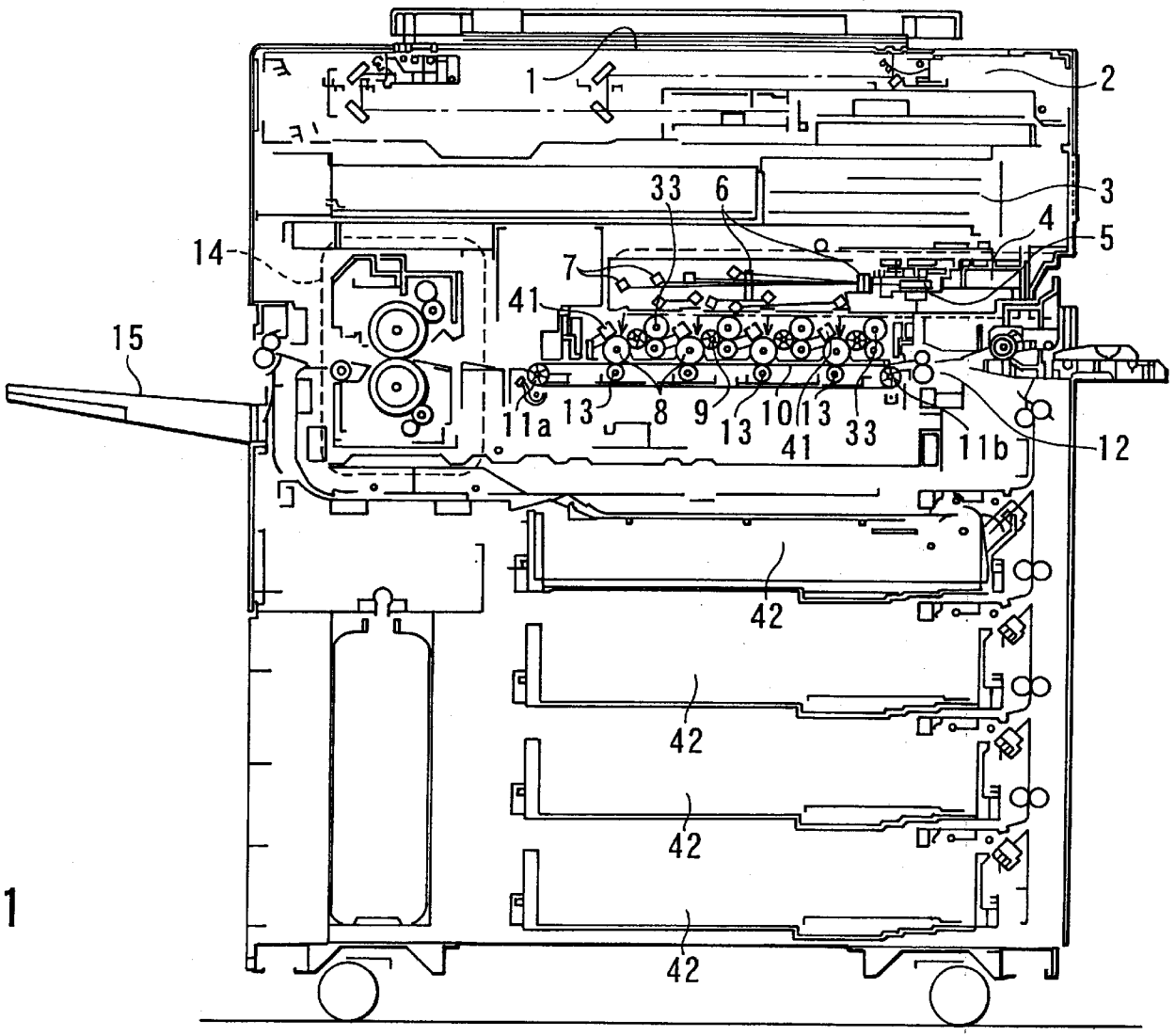
FIG. 1 is a schematic diagram of a color electrophotographic apparatus according to the embodiment of the present invention.

FIG. 1 shows an inner structure of a quad-tandem full-color electrophotographic copier serving as a multi-color image forming apparatus, according to the embodiment of the present invention.

A document table 1 is provided at a top surface portion of the electrophotographic copier. A scanner 2 for scanning image data of the document placed on the document table 1 is provided under the document table 1. An image data processing circuit 3 for capturing data from an external device such as a computer, storing the data in an image memory and processing the images is provided below the scanner 2.

An exposure device 4 such as a laser beam generator for each color is provided under the image data processing circuit 3. The exposure device 4 comprises a polygon mirror 5 for executing the scanning by reflecting a beam generated by the laser beam generator, a fθ lens 6 for correcting a focal point, and a returning mirror 7 for returning the scanned beam.

A plurality of image forming units 33 constituting an image forming section are aligned along the sheet conveying direction, under the exposure device 4.

Each of the image forming units 33 comprises a photosensitive drum 8, and a developing device 9 is arranged opposite to the photosensitive drum 8. The developing device 9 of the image forming unit 33 positioned at the most upstream side in the sheet conveying direction contains toner (developer) of yellow (Y). The developing devices 9 of the image forming units 33 positioned at the downstream side in the sheet conveying direction respectively contain toner of magenta (M), cyan (C) and black (K) in order.

A transfer belt 10 serving as a transfer section is provided under the photosensitive drums 8 of the image forming units 33. The transfer belt 10 bridges between a driving roller 11*a* and a follower roller 11*b*. The transfer belt 10 receives and conveys the sheet as a member on which the image data is transferred. The transfer belt 10 is provided so that an outer peripheral surface thereof is brought into contact with the photosensitive drum 8, and transfer rollers 13 for allowing the toner image to be transferred on the sheet or the transfer belt 10 is aligned at the inner surface side of the transfer belt 10.

A plurality of photosensitive drums 8 are driven to rotate by respective motors (not shown), and the rotary speed of the photosensitive drums 8 is controlled so that the outer circumferential speed of the photosensitive drums 8 are equivalent to the circumferential speed of the transfer belt 10. Aligning roller pairs 12 for aligning and feeding the sheets are provided in close vicinity of the sheet introducing side of the transfer belt 10.

The photosensitive drums 8 for the respective colors are aligned with a predetermined gap. Therefore, the timing for image formation for the photosensitive drums 8 is shifted in time and the toner of four colors, yellow (Y), magenta (M), cyan (C) and black (K) is superposed without displacement to form the color image.

A fixing device 14 for fixing the toner image transferred on the sheet and a delivery tray 15 for receiving the delivered sheet are provided at the downstream side of the sheet conveying direction of the transfer belt 10.

When the image is formed, the image data of the document placed on the document table 1 is read by the scanner 2 or the data from an external device such as a computer is read, stored in the image memory and processed by the image data processing circuit 3. The data of the image processed for each color by the image data processing circuit 3 is supplied to the exposure device 4 for each color under the control of the image formation timing control circuit, and scanned by reflecting the beam generated by the laser beam generator on the polygon mirror 5. After that, the focal point of this beam is corrected by the fθ lens 6, and the optical path is changed by the returning mirror 7 to lead the beam to the photosensitive drums 8. The peripheral surface of each of the photosensitive drums 8 is charged at a predetermined potential by a charger 41. An electrostatic latent image is formed thereon by irradiating the light whose path is changed by the returning mirror 7. The electrostatic latent images are made to face the developing devices 9 by the rotation of the photosensitive drums 8 and developed by the toner supplied from the developing devices 9 to be the toner images.

At this time, a feeding cassette 42 feeds the sheet, which is aligned by the aligning roller pairs 12 and fed to the transfer belt 10. The sheet fed to the transfer belt 10 is conveyed to the photosensitive drums 8 by the moving transfer belt 10. The toner images are sequentially transferred from the photosensitive drums 8 and superposed, and thus the color image is formed. The sheet on which the color image is formed is introduced into the fixing device 14. The sheet is pressurized while heated and therefore the toner image is fixed on the sheet. After the fixation, the sheet is delivered onto the delivery tray 15.

Figure 2:
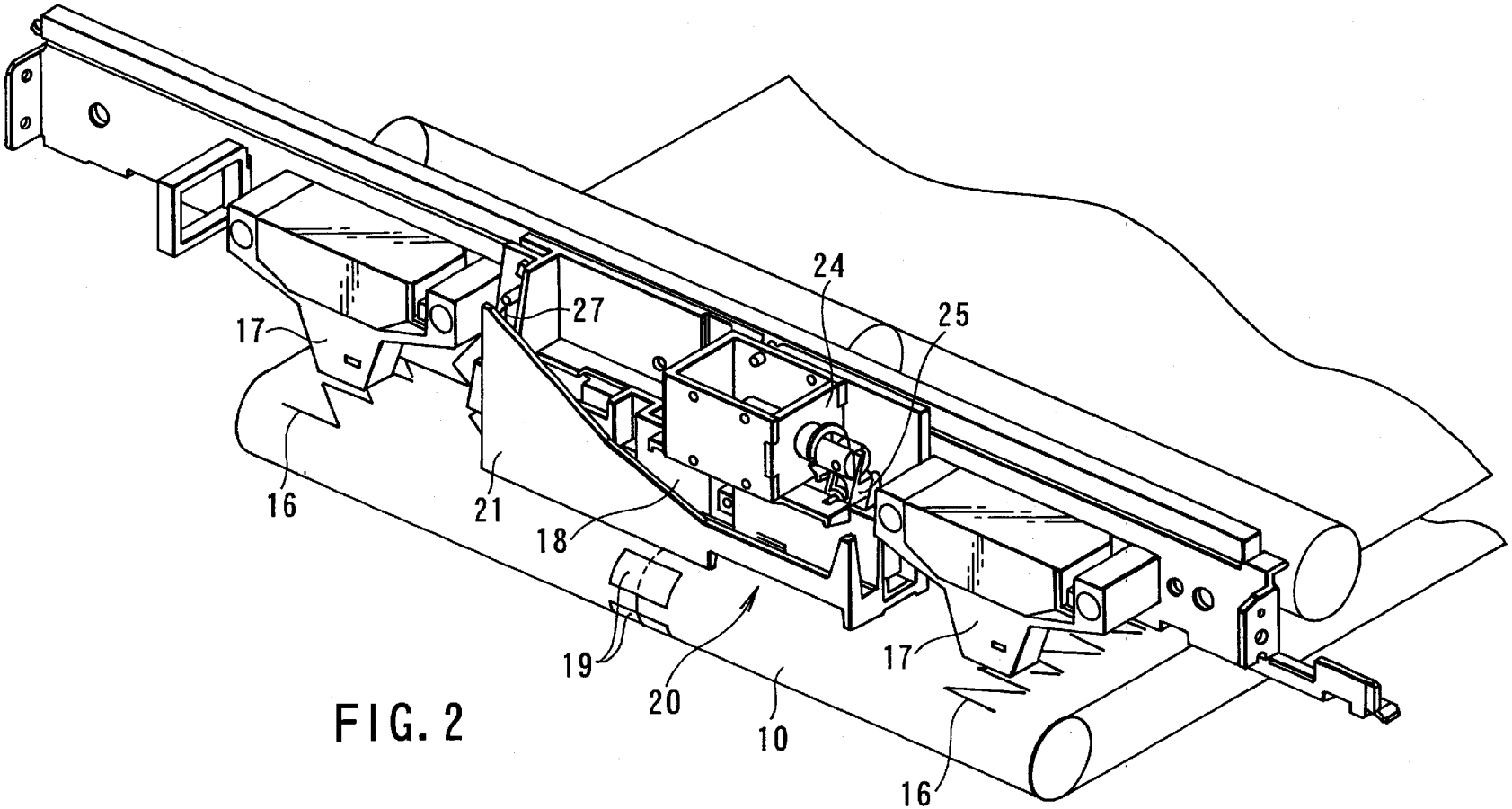
FIG. 2 is a perspective view of a toner density sensor and an image displacement sensor.

FIG. 2 is a perspective view of sensors (hereinafter "displacement sensors") 17, 17 for detecting the image displacement and a sensor (hereinafter "density sensor") 18 for detecting the image density, which serve as the detecting means arranged at the most downstream side of the sheet conveying direction of the transfer belt 10.

Figure 14:
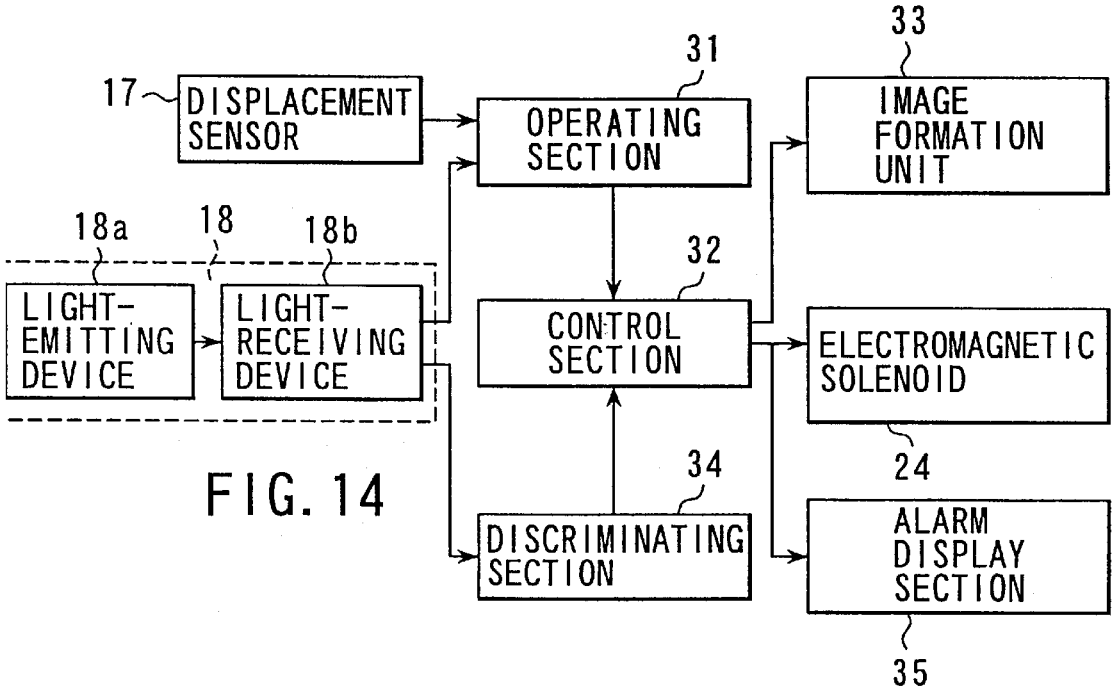
FIG. 14 is a block diagram of a drive control system for an image forming unit and the opening/closing mechanism.

The displacement sensors 17, 17 and the density sensor 18 are arranged in a direction orthogonal with the sheet conveying direction. The displacement sensors 17, 17 and the density sensor 18 are connected to an operating section 31 via a signal path as shown in FIG. 14 and a control section 32 is connected to the operating section 31 via a signal path. The image formation unit 33 is connected to the control section 32 via a control circuit.

The density sensor 18 comprises a light-emitting device (LED) 18A and a light-receiving device 18B. The light emitted from the LED 18A is irradiated and reflected at the transfer belt 10 and is received by the light-receiving device 18B.

A discriminating section 34 for optically discriminating the operating state of the shutter plate 22 as described later is connected to the light-receiving device 18B of the density sensor 18. The discriminating section 34 is connected to the control section 32 via a signal path.

Further, a solenoid 24 for opening and closing the shutter plate 22 and an alarm display section 35 provided on an operation panel for displaying an alarm message are connected to the control section 32 via the control circuit.

At the time of compensating for the image displacement, a specific shape pattern, what is called a registration mark 16, for detecting the relative displacement of an actual image is formed on the transfer belt 10 by the image formation unit 33 as shown in FIG. 2. The registration marks 16 pass the displacement sensors 17, 17 and are thereby optically detected. After the detection, detection signals are transmitted from the displacement sensors 17, 17 to the operating section 31, which processes a detection time difference of a plurality of mark signals to obtain an amount of compensation. After that, the control section 32 compensates for the exposure timing of each image formation unit 33 in accordance with the amount of compensation and thereby the image displacement is controlled at an allowable level.

At the time of compensating for the image density, a patch mark 19 serving as a control mark is formed at a substantially central portion in the width direction of the transfer belt 10 by the image formation unit 33. When the patch mark 19 passes the density sensor 18 by the motion of the transfer belt 10, the patch mark 19 is optically detected by the density sensor 18. This detection information is transmitted to the operating section 31 and processed, and thus the density is detected. Subsequently, the adjusted amount is obtained by the control section 32 on the basis of the detected density, so as to compensate for the charging amount of the photosensitive drum 8 in the image formation unit 33 and control the toner density at the allowable level.

Figure 3:
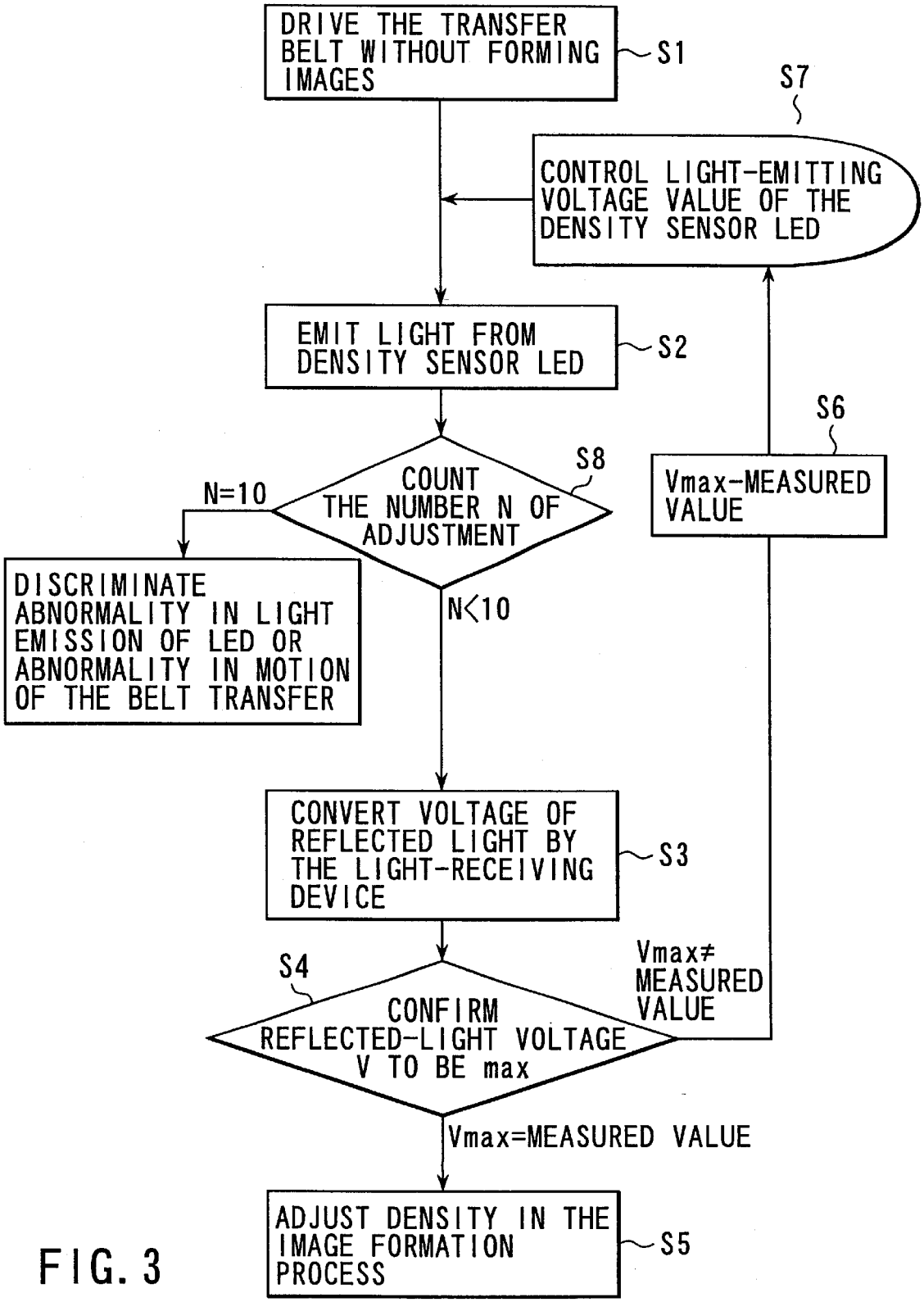
FIG. 3 is a flow chart of preliminary operations before adjustment of the toner density.

FIG. 3 is a flow chart of an operation of adjusting default values by the density sensor 18 before the adjustment of the image density.

First, the image formation unit 33 is not operated, but the only transfer belt 10 is moved (step S1). Next, the light-emitting device 18A of the density sensor 18 is operated to emit the light (step S2). The light emission allows the light to be irradiated to the transfer belt 10 to which no toner adheres, and the light reflected from the transfer belt 10 is received by the light-receiving device 18B and voltage-converted (step S3). After that, it is discriminated whether or not the measured value of the converted reflected-light voltage V is max or not (step S4). If the measured value is max, adjustment of the toner density is started by the image formation unit 33 (step S5).

If it is discriminated at step S4 that the measured value of the reflected-light voltage V is not max, the difference between the max value and the measured value is detected (step S6). The voltage value of the light-emitting device 18A of the density sensor 18 is controlled in accordance with the difference (step S7), and the operation shifts to step S2. The number of control of the voltage value is counted and it is discriminated whether the count number N is smaller than 10 or not (step S8). If the count number N is smaller than 10, the operations after step S3 are repeated. If it is discriminated that the count number N is 10, it is discriminated that this indicates the abnormality in the light emission of the light-emitting device 18A or the abnormality in the motion of the transfer belt 10, and thereby the adjustment operations are stopped.

Figure 4:
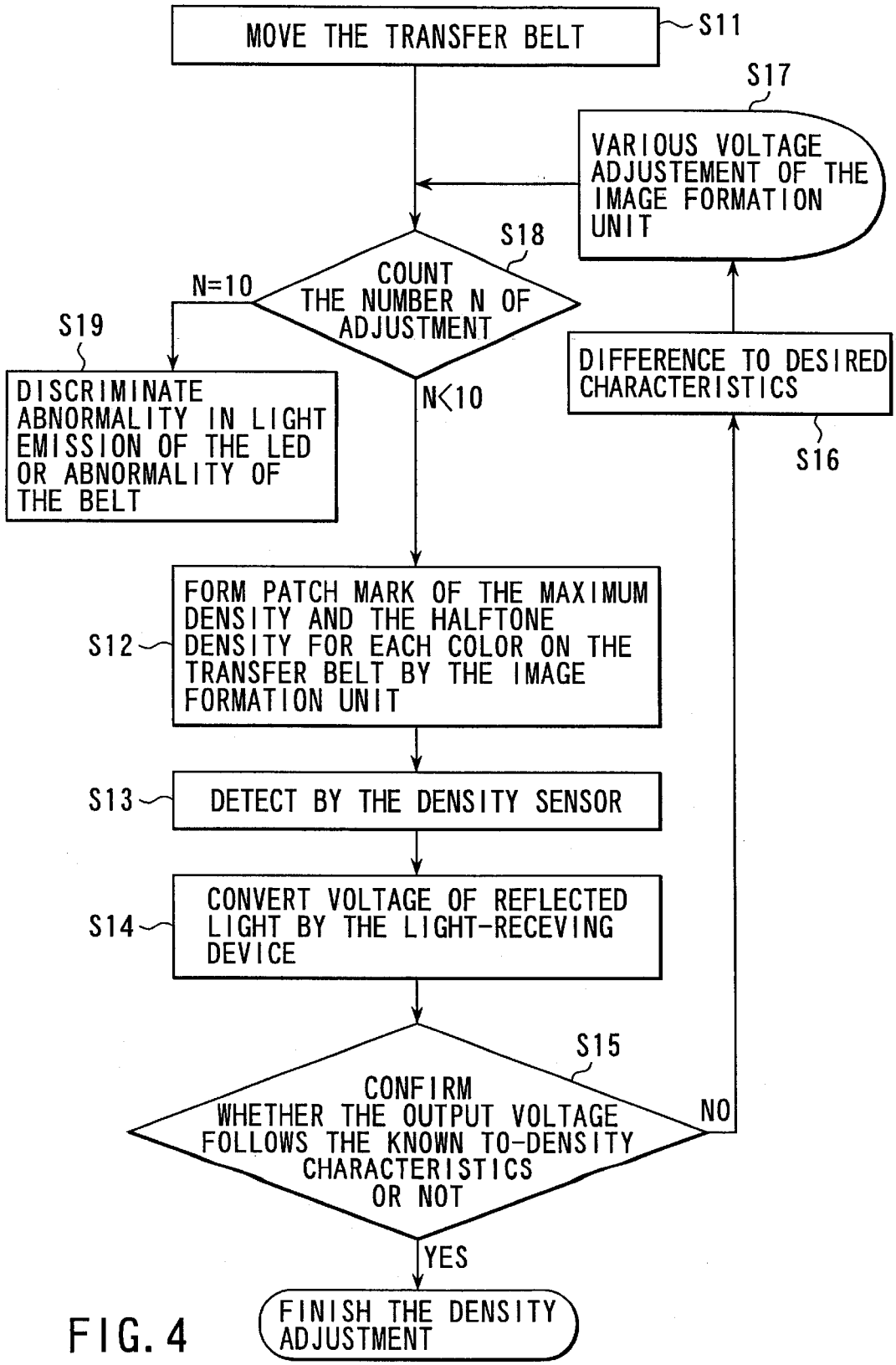
FIG. 4 is a flow chart of adjustment of the toner density.

FIG. 4 is a flow chart of adjustment of the toner density by the image formation unit 33.

First, the transfer belt 10 is moved (step S11). Next, the image formation unit 33 is operated to form the patch mark 19 (i.e. a square of a few $cm^2$) of the maximum density and the halftone density for each color on the transfer belt 10 as shown in FIG. 2 (step S12). When the patch mark 19 passes under the density sensor 18, it is optically detected by the density sensor 18 (step S13). That is, the light emitted from the light-emitting device 18A of the density sensor 18 is irradiated onto the patch mark 19, the light reflected from the patch mark 19 is received by the light-receiving device 18B and thereby the patch mark 19 is detected. The light received by the light-receiving device 18B is voltage-converted (step S14). After that, it is discriminated whether the converted voltage value follows the known to-density characteristics or not (step S15). If it is discriminated that the converted voltage value follows the to-density characteristics, adjustment of the toner density is finished. If it is discriminated that the converted voltage value does not follow the characteristics, the difference to the desired toner density characteristics is calculated (step S16) and the voltage adjustment of the image formation unit 33 is variously executed in accordance with the difference (step S17). After the number of adjustment is counted (step S18), the operations after step S12 are executed if the number of adjustment is smaller than ten. If the number of adjustment is ten, occurrence of the abnormality in the light emission of the light-emitting device (LED) 18A or abnormality in the motion of the transfer belt 10 is discriminated and the density adjustment is stopped (step S19).

After detected by the sensors 17 and 18, the marks 16 and 19 formed on the transfer belt 10 are shaved by a belt cleaner (not shown) and removed from the transfer belt 10.

Figure 5:
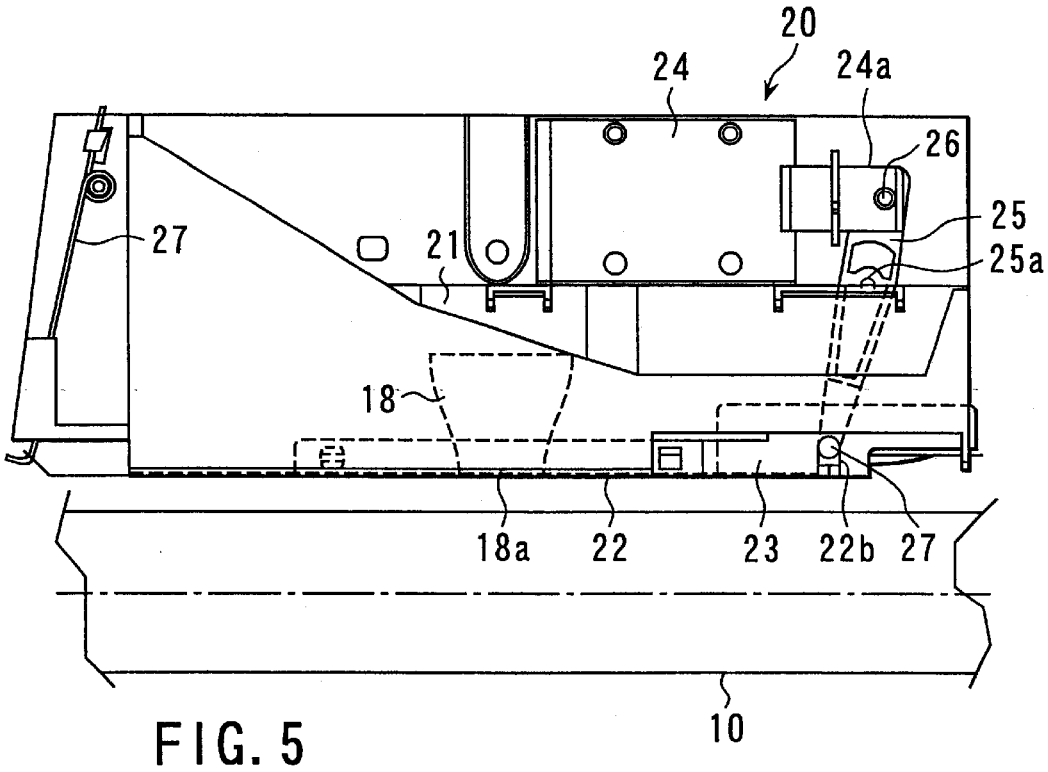
FIG. 5 is a side view of an opening/closing mechanism.
Figure 6:
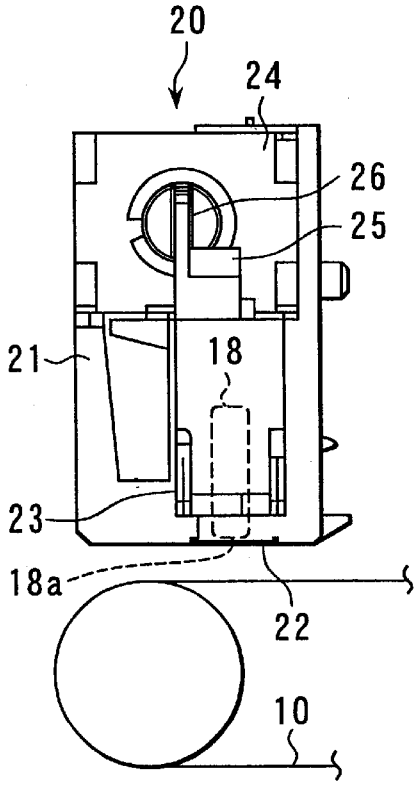
FIG. 6 is a front view of the opening/closing mechanism.
Figure 7:
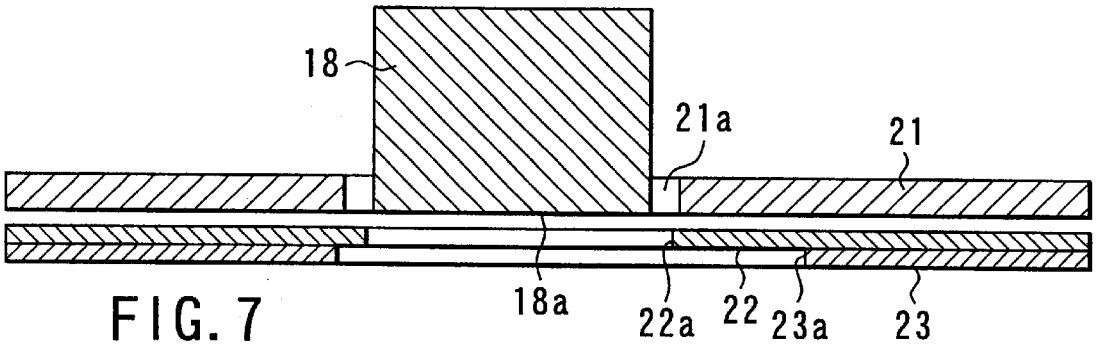
FIG. 7 is a sectional view of a shutter plate of the opening/closing mechanism.

FIG. 5 is a side view of an opening/closing mechanism 20 for opening/closing a detecting surface 18a of the density sensor 18. FIG. 6 is a front view, and FIG. 7 is a partially-expanded sectional view.

The density sensor 18 has the detecting surface 18*a* on its lower surface part. The entire sensor is surrounded by a casing 21 to prevent the flying toner from adhering to the sensor. The lower surface part of the casing 21 is positioned to be equal to the detecting surface 18*a* of the density sensor 18. An opening portion 21*a* is provided at the lower surface portion of the casing 21. The detecting surface 18*a* of the sensor 18 is arranged within the opening portion 21*a*.

The slider plate 22 serving as an opening/closing member is slidably attached to the casing 21 via the cover member 23 so as to face the detecting surface 18*a* of the sensor 18 via an extremely small gap of a few microns. The shutter plate 22 is moved parallel to the surface of the transfer belt 10 along the direction of the width thereof.

The shutter plate 22 and the cover plate 23 are arranged in a range of a very small distance from the detecting surface 18a of the density sensor 18 to the surface of the transfer belt 10. However, the shutter plate 22 and the cover plate 23 do not prevent the sheets from being conveyed by the transfer belt 10 since the shutter plate 22 and the cover plate 23 are very thin.

Opening portions 22*a* and 23*a* are formed on the shutter plate 22 and the cover plate 23. When the shutter plate 22 slides to a predetermined position, the opening portions 22*a* and 23*a* face one another so that the detecting surface 18*a* of the density sensor 18 is exposed to the transfer belt 10.

The electromagnetic solenoid 24 for moving the shutter plate 22 is attached to the upper part of the casing 21.

On the other hand, a lever 25 is pivotally attached to the casing 21 via a shaft 25*a*. An actuator 24*a* of the electromagnetic solenoid 24 is connected to the upper end portion of the lever 25 via a pin 26. An end portion of the shutter plate 22 is connected to the lower end portion of the lever 25 via a pin 27.

A helical torsion spring 27 is attached to the casing 21 and a lower end portion of the helical torsion spring 27 is connected to the other end portion of the shutter plate 22. The shutter plate 22 pulled by the electromagnetic force of the electromagnetic solenoid 24 is returned to the initial position by the spring force of the helical torsion spring 27. The helical torsion spring 27 is vertically provided to prevent the opening/closing mechanism 20 from extending in the width direction.

Figure 8:
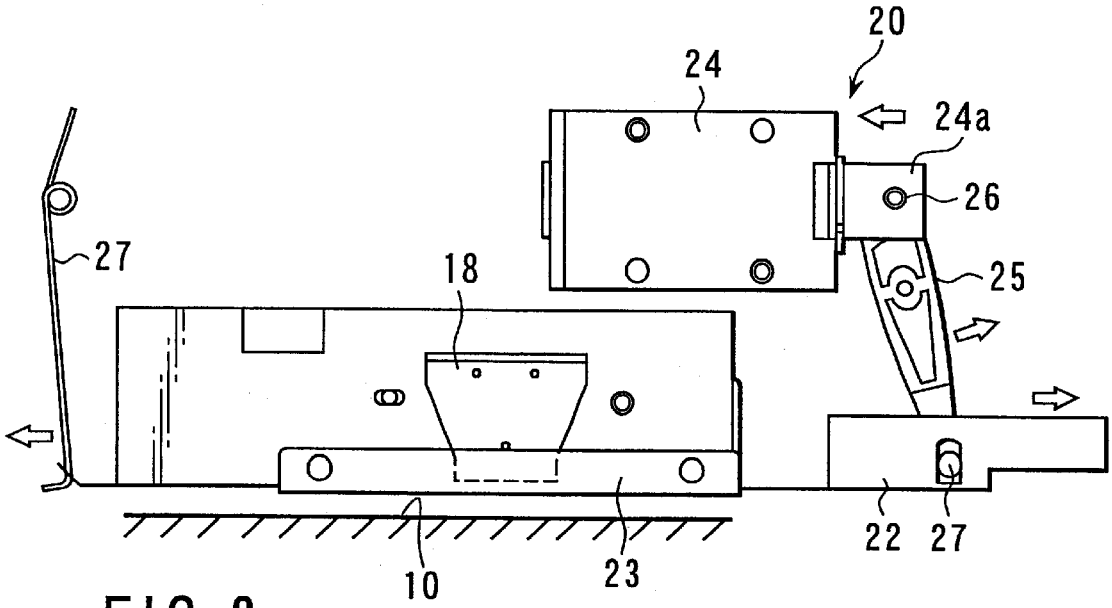
FIG. 8 is a side view of an opening operation of the shutter plate.
Figure 9:
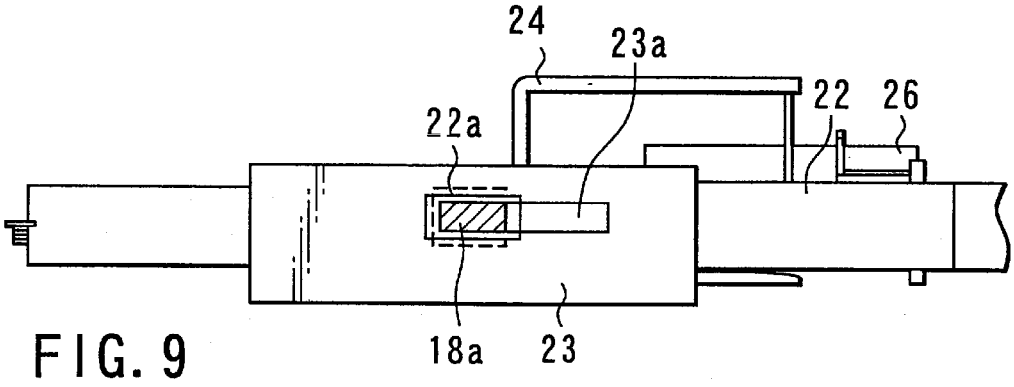
FIG. 9 is a bottom view of the opening operation of the shutter plate.

When the electromagnetic solenoid 24 is turned on, the lever 25 is pivoted via the actuator 24*a* and the shutter plate 22 is moved against the urging force of the helical torsion spring 27 as shown in FIGS. 8 and 9. This movement allows the opening portion 22*a* of the shutter plate 22 to face the detecting surface 18*a* of the sensor 18 and thereby the detecting surface 18*a* is opened.

Figure 11:
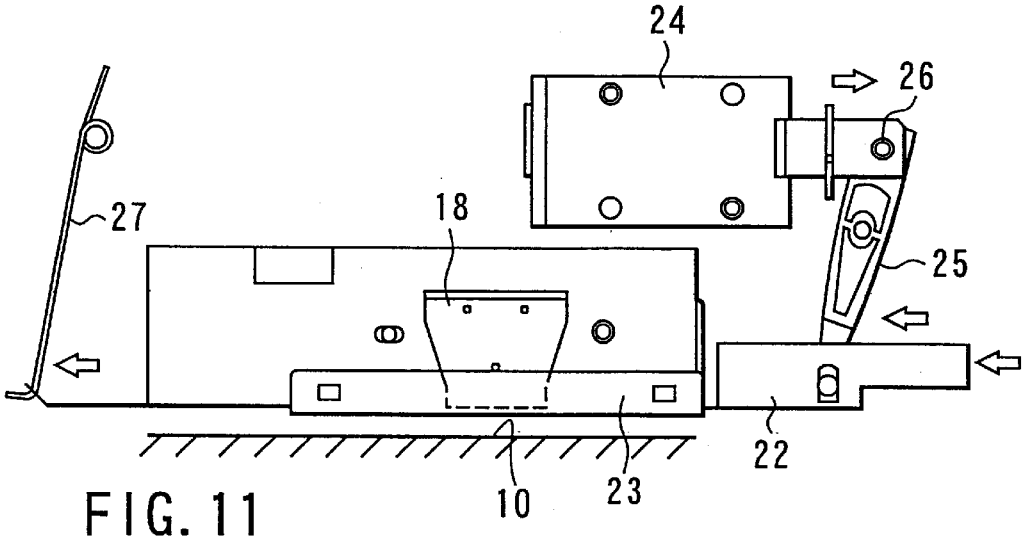
FIG. 11 is a front view of a closing operation of the shutter plate.
Figure 12:
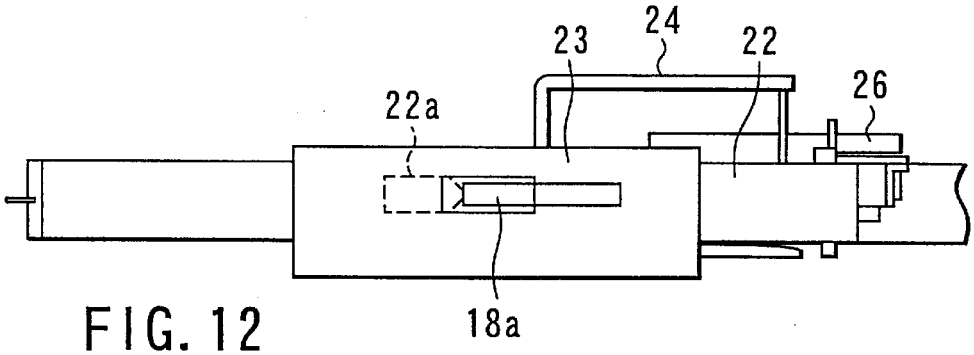
FIG. 12 is a bottom view of the closing operation of the shutter plate.

When the electromagnetic solenoid 24 is turned off, the urging force of the helical torsion spring 27 urges the shutter plate 22 to move in the returning direction and face the detecting surface 18*a*, and thereby the detecting surface 18*a* is closed, as shown in FIGS. 11 and 12. This closing operation can restrict the amount of the toner attached to the detecting surface 18*a* of the sensor 18 to the minimum limit.

Figure 10:
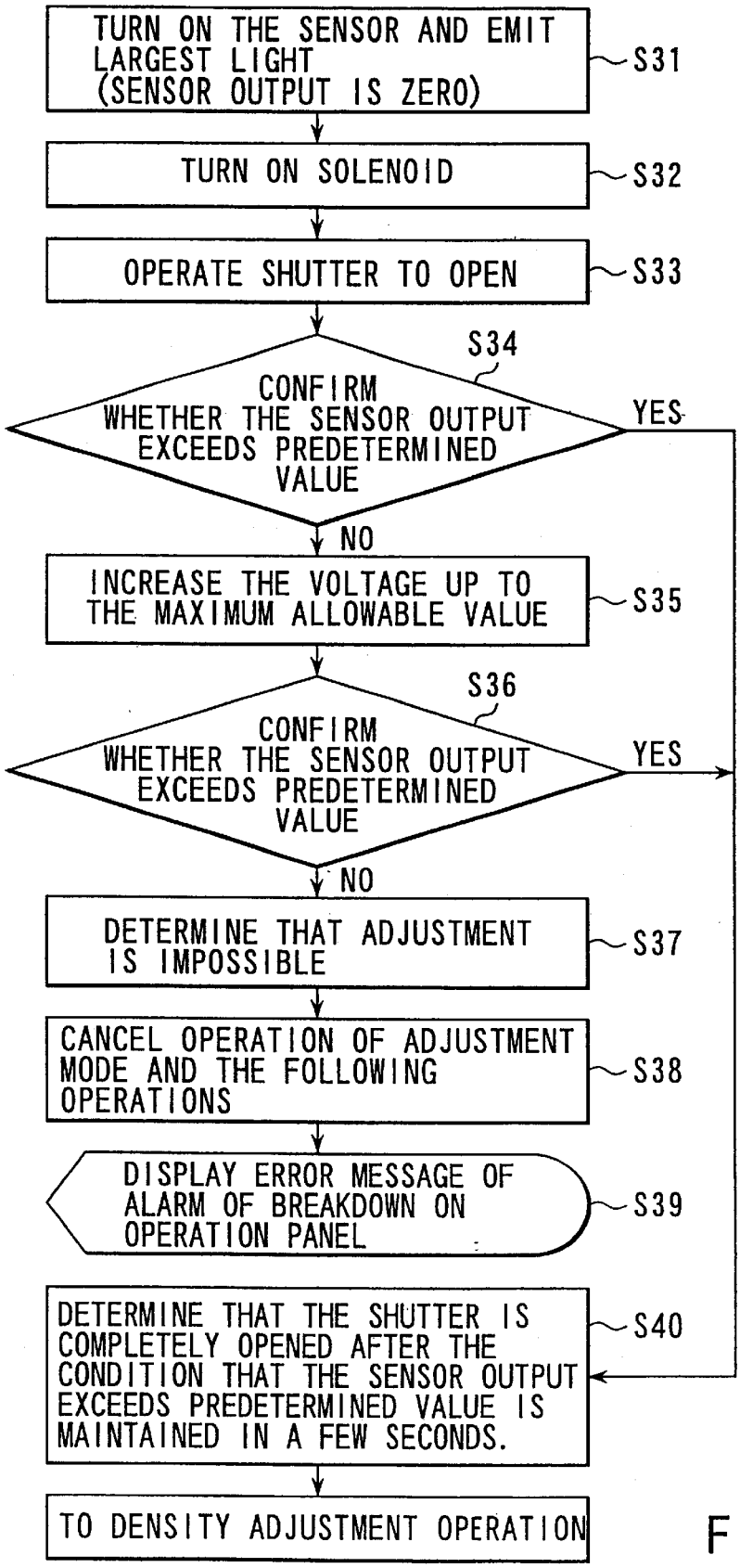
FIG. 10 is a flow chart of the shutter opening operation before adjustment of the toner density.

FIG. 10 is a flow chart of the opening operation of the shutter 22, which is executed before adjustment of the toner density, and the discriminating operation to discriminate whether the opening operation is normally executed or not.

First, the density sensor 18 is turned on to emit the largest light (step S31). At this time, the light emitted from the light-emitting device 18A of the density sensor 18 cannot be received by the light-receiving device 18B since the detecting surface 18*a* of the density sensor 18 is closed by the shutter plate 22. Therefore, the output of the light-receiving device 18B is zero. After that, the electromagnetic solenoid 24 is turned on to pull the actuator 24*a* (step S32). The lever 25 is thereby pivoted against the urging force of the helical torsion spring 27, and the shutter plate 22 is moved and stopped at a position where the opening portion 22*a* thereof faces the detecting surface 18*a*. Therefore, the detecting surface 18*a* of the density sensor 18 is opened and exposed (step S33). This exposure allows the light from the density sensor 18 to be irradiated onto the transfer belt 10 and reflected therefrom. The reflected light is received and output by the light-receiving device 18B of the sensor 18. Next, it is discriminated by the discriminating section 34 whether the output value of the light-receiving device 18B exceeds a predetermined value or not (step S34). If the output value does not exceed the predetermined value, the voltage applied to the electromagnetic solenoid 24 is increased to the maximum allowable level to increase the operating force (step S35). It is discriminated again by the discriminating section 34 whether the output value of the light-receiving device 18B exceeds a predetermined value or not (step S36). If it is discriminated that the output value does not exceed the predetermined value, the impossibility of adjustment is discriminated without finishing the complete opening (step S37), and the operation of the adjusting mode and the following operations are canceled (step S38). After that, an error message indicating an alarm for breakdown is displayed on a user operation panel (step S39). If it is discriminated at steps 34 and 35 that the output of the sensor is over the predetermined value, it is discriminated after a few seconds that the shutter plate 22 has completely opened (step S40), and the operation of adjusting the density is started.

Figure 13:
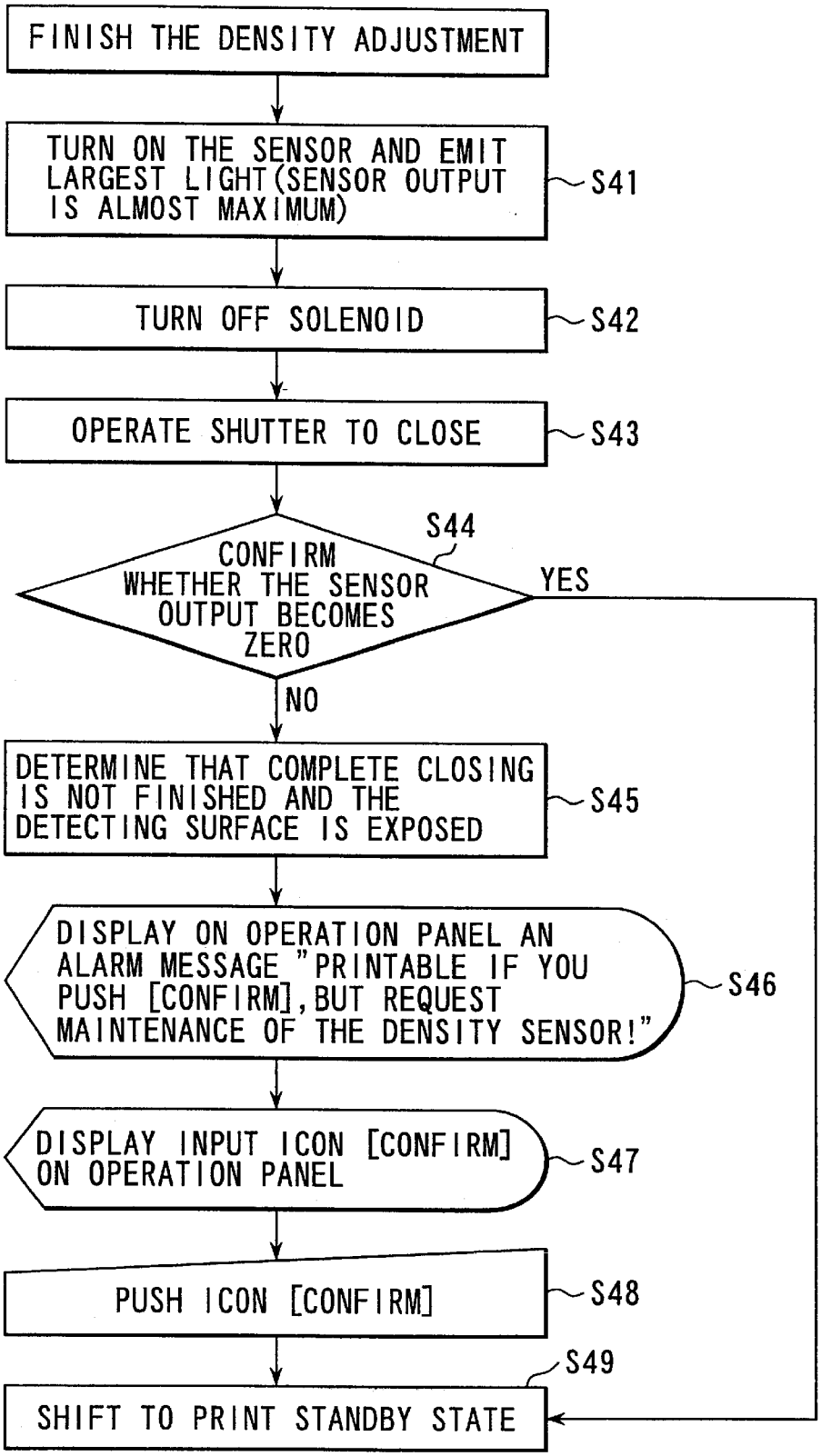
FIG. 13 is a flow chart of the shutter closing operation after adjustment of the toner density.

FIG. 13 is a flow chart of the closing operation of the shutter 22, which is executed after adjustment of the toner density, and the discriminating operation to discriminate whether the closing operation is normally executed or not.

First, the density sensor 18 is turned on to emit the largest light (step S41). At this time, the light emitted from the light-emitting device 18A of the density sensor 18 is irradiated onto the surface of the transfer belt 10 and received by the light-receiving device 18B, so that the output of the sensor becomes maximum. After that, the electromagnetic solenoid 24 is turned off (step S42). The urging force of the helical torsion spring 27 allows the shutter plate 22 to return and the detecting surface 22*a* thereof to move from the detecting surface 18*a* of the density sensor 18. The detecting surface 18*a* is thereby closed by the shutter plate 22 (step S43) and, thus, the light emitted from the light-emitting device 18A of the density sensor 18 is not received by the light-receiving device 18B. After that, it is discriminated by the discriminating section 34 whether the output of the light-receiving device 18B becomes zero or not (step S44). If it is confirmed that the output of the sensor is not zero, it is discriminated that the complete closing of the detecting surface 18*a* has not yet been finished and the detecting surface 18*a* is still exposed (step S45). In accordance with the discrimination, an alarm message is displayed on the display section 35 of the operation panel (step S46). An input icon for confirmation is displayed on the operation panel (step S47). If the confirmation icon is pushed on (step S48), the operation shifts to the printing standby state (step S49). Even if the detecting surface 18a is opened, the image formation can be executed since the contamination caused by the adherent toner is not immediately increased. If it is confirmed at step S44 that the sensor output is zero, the operation shifts to step S49.

The structure of the opening/closing mechanism 20 is not limited to the above-described one. For example, a motor may be used in place of the electromagnetic solenoid 24 as the drive source for opening/closing the shutter plate 22. That is, the opening/closing mechanism operated in the same manner as the above explained one can be constituted by attaching a worm gear on the output shaft of the motor, attaching a gear in a worm wheel shape on the lever 25 and making the worm gear and the gear in a worm wheel shape engage with one another.

Thus, if a motor is utilized as a drive source, the electromagnetic solenoid 24 does not need to be turned on after the opening to the detecting surface 18a of the density sensor 18 has been finished, which will bring about a merit of saving the electricity and facilitate the control of opening/closing the shutter.

Figure 15:
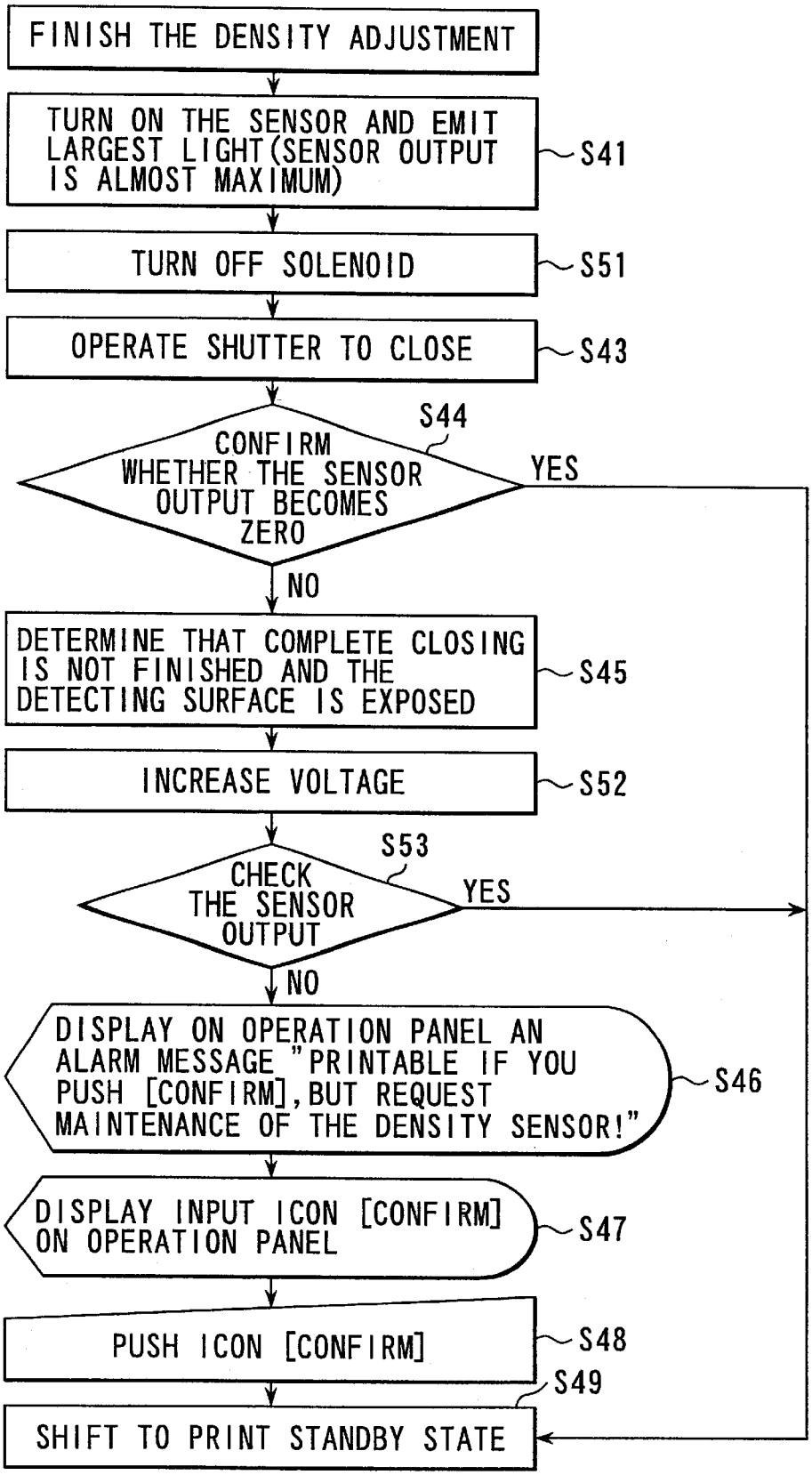
FIG. 15 is a flow chart of the shutter closing operation after adjustment of the toner density, according to another embodiment of the present invention.

FIG. 15 is a flow chart of the operations in a case where a motor is utilized as a drive source of the shutter plate 22. The same portions as those shown in FIG. 13 are denoted by the same reference numerals and their explanation is omitted here.

When the shutter is closed, if the sensor output does not become zero even after the time to finish the operation has passed, it is discriminated that the operation has not yet been completely finished (step S45). The voltage applied to the motor is increased to the maximum allowable level to increase the operating power (step S52). The sensor output is checked, and if it becomes zero (step S53), it is discriminated that the shutter reaches at the position where the operation should be finished and the motor is turned off. If the sensor output does not become zero even when the voltage is increased, this condition is discriminated as abnormality and the previously explained operation is executed.

In the above-described embodiment, the density sensor 18 is utilized as the detection means for detecting the mark for the image control and confirming the opening/closing operations of the opening/closing mechanism 20. However, the present invention is not limited to this and, the displacement sensor 17 can be utilized instead.

As described above, in the present invention, the shutter plate 22 is slidably provided between the detecting surface 18a of the density sensor 18 and the transfer belt 10. In a case where the mark 19 for the image formation control is not detected by the density sensor 18, the detecting surface 18*a* of the density sensor 18 is closed by the shutter plate 22. Therefore, flying toner does not adhere to the detecting surface 18*a* and the accuracy in detection of the mark 19 can be preferably maintained for a long time.

In addition, the opening/closing condition of the shutter plate 22 is detected by the density sensor 18. Therefore, a device for detecting the opening/closing condition of the shutter plate 22 does not need to be especially provided and the present invention can be structurally simplified.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

an image forming means for forming a developer image on an image carrier;

a detecting means for detecting the developer image formed by said image forming means;

a control means for controlling the formation of the developer image on said image carrier executed by said image forming means, in accordance with detection information of said detecting means;

an opening/closing member for opening a detecting surface of said detecting means when said developer image is detected by said detecting means, and for covering the detecting surface thereof when said developer image is not detected; and a discriminating means for discriminating a condition of the operation of said opening/closing member by using a result of the detection of the developer image executed by said detecting means.

2. An image forming apparatus according to claim 1, further comprising a transfer means for conveying a member on which the developer image is to be transferred while placing the member on a transfer surface, and allowing the developer image formed on said image carrier to be transferred on said member or allowing the developer image to be directly transferred on said transfer surface as a mark for control of the image formation.

3. An image forming apparatus according to claim 2, wherein said detecting means is provided so that the detecting surface thereof faces the transfer surface of said transfer means, to optically detect the control mark formed on said transfer surface.

4. An image forming apparatus comprising:

an image forming means for forming a developer image on an image carrier;

a transfer means for conveying a member on which the developer image is to be transferred while placing the member on a transfer surface, and allowing the developer image formed on said image carrier to be transferred on said member or allowing the developer image to be directly transferred on said transfer surface as a mark for control of the image formation;

a detecting means provided so that a detecting surface thereof faces the transfer surface of said transfer means, for optically detecting the control mark formed on said transfer surface;

a control means for controlling the formation of the developer image on said image carrier executed by said image forming means, in accordance with detection information of said detecting means;

an opening/closing member movably provided between the detecting surface of said detecting means and the transfer surface, for moving in a first direction and opening the detecting surface of said detecting means when the control mark is detected by said detecting means and for moving in a second direction opposite to the first direction and covering the detecting surface of said detecting means when the control mark is not detected; and a discriminating means for discriminating a condition of the operation of said opening/closing member by using a result of the detection of the control mark executed by said detecting means when said opening/closing means executes the opening/closing operation.

5. An image forming apparatus according to claim 4, wherein when said discriminating means discriminates that the opening/closing condition of said opening/closing member is not normal, said discriminating means allows a drive force opening or closing said opening/closing member to be increased.

6. An image forming apparatus according to claim 5, further comprising an alarm means for generating an alarm when it is discriminated that the opening/closing condition of said opening/closing member is not normal even if the drive force opening or closing said opening/closing member is increased.

7. An image forming apparatus according to claim 4, wherein said control mark is used to detect density of said developer image.

8. An image forming apparatus according to claim 4, wherein said control mark is used to detect displacement of said developer image.

9. An image forming apparatus according to claim 4, wherein said detecting surface is positioned on said transfer surface.

10. An image forming apparatus according to claim 4, wherein said opening/closing member is arranged parallel to the transfer surface of said transfer means and moves back and forth in a direction crossing the conveying direction of said image-transferred member.

11. An image forming apparatus according to claim 4, wherein a plurality of image forming means are aligned in a predetermined direction, said transfer means faces the image carriers of said plurality of image forming means, and said transfer means conveys the image-transferred member to the image carriers thereof sequentially and transfers the developer images of different colors on the image-transferred member.

12. An image forming method comprising the steps of:

forming a developer image on an image carrier;

detecting the developer image formed at said image forming step, by a detecting means;

controlling the formation of the developer image on said image carrier executed at said image forming step, in accordance with detection information obtained at said detecting step;

operating an opening/closing member for opening a detecting surface of said detecting means when said developer image is detected by said detecting means, and for covering the detecting surface thereof when said developer image is not detected; and discriminating a condition of the operation of said opening/closing member by using a result of the detection of the developer image executed by said detecting means.

13. An image forming method according to claim 12, further comprising a step of conveying a member on which the developer image is to be transferred while placing the member on a transfer surface of a transfer means, and allowing the developer image formed on said image carrier to be transferred on said member or allowing the developer image to be directly transferred on said transfer surface as a mark for control of the image formation.

14. An image forming method according to claim 13, wherein at said detecting step, the control mark formed on said transfer surface is optically detected by said detecting means that is provided such that the detecting surface thereof faces the transfer surface of said transfer means.

15. An image forming method comprising the steps of:

forming a developer image on an image carrier;

conveying a member on which the developer image is to be transferred while placing the member on a transfer surface of a transfer means, and allowing the developer image formed on said image carrier to be transferred on said member or allowing the developer image to be directly transferred on said transfer surface as a mark for control of the image formation;

optically detecting the control mark formed on said transfer surface of said transfer means while a detecting surface faces the transfer surface of said transfer means;

controlling the formation of the developer image on said image carrier executed at said image forming step, in accordance with detection information obtained at said detecting step;

moving an opening/closing member in a first direction and opening the detecting surface of said detecting means when the control mark is detected by said detecting means and moving the opening/closing member in a second direction opposite to the first direction and covering the detecting surface of said detecting means when the control mark is not detected; and optically discriminating a condition of the operation of said opening/closing member by using a result of the detection of the control mark executed by said detecting means when said opening/closing means executes the opening/closing operation.

16. An image forming method according to claim 15, wherein when it is discriminated at said discriminating step that the opening/closing condition of said opening/closing member is not normal, a drive force opening or closing said opening/closing member is increased.

17. An image forming method according to claim 16, further comprising a step of generating an alarm when it is discriminated that the opening/closing condition of said opening/closing member is not normal even if the drive force opening or closing said opening/closing member is increased.

18. An image forming method according to claim 15, wherein said control mark is used to detect density of said developer image.

19. An image forming method according to claim 15, wherein said control mark is used to detect displacement of said developer image.

20. An image forming method according to claim 15, wherein said detecting surface is positioned on said transfer surface.

21. An image forming method according to claim 15, wherein said opening/closing member is arranged parallel to the transfer surface of said transfer means and moves back and forth in a direction crossing the conveying direction of said image-transferred member.

22. An image forming method according to claim 15, wherein at said image forming step, said transfer means is provided to face a plurality of image forming means aligned in a predetermined direction, and said transfer means conveys the image-transferred member to the image carriers thereof sequentially and transfers the developer images of different colors on the image-transferred member.

* * * * *